United States Patent [19]

Patthey

[11] 4,179,906

[45] Dec. 25, 1979

[54] KNITTING METHOD AND APPARATUS

[75] Inventor: Michel Patthey, Couvet, Switzerland

[73] Assignee: Edouard Dubied & Cie. (Societe Anonyme), Couvet, Switzerland

[21] Appl. No.: 886,541

[22] Filed: Mar. 14, 1978

[30] Foreign Application Priority Data

Mar. 14, 1977 [CH] Switzerland ..... 3137/77

[51] Int. Cl.[2] ..... D04B 15/52; D04B 15/56; D04B 15/64

[52] U.S. Cl. ..... 66/128

[58] Field of Search ..... 66/125, 126 R, 127, 66/128, 138, 139

[56] References Cited

U.S. PATENT DOCUMENTS

| | | | |
|---|---|---|---|
| 1,990,440 | 2/1935 | Steinhart | 66/128 |
| 2,030,697 | 2/1936 | Friedmann | 66/128 |
| 2,132,971 | 10/1938 | Roques | 66/126 R |
| 2,286,227 | 6/1942 | Ralston | 66/128 |
| 3,364,703 | 1/1968 | Krause | 66/126 R |
| 4,052,865 | 10/1977 | Zamarco | 66/127 |

FOREIGN PATENT DOCUMENTS

| | | | |
|---|---|---|---|
| 2448947 | 12/1975 | Fed. Rep. of Germany | 66/128 |
| 904751 | 6/1969 | United Kingdom | 66/128 |

*Primary Examiner*—Ronald Feldbaum
*Attorney, Agent, or Firm*—Lewis H. Eslinger

[57] ABSTRACT

A method and apparatus are disclosed for knitting sections of predetermined contour and/or of a design of the Intarsia type of predetermined shape in which a yarn guide member is moved along a bank of needles in a knitting machine between a pair of carrier splicing blocks which are movably mounted in the machine. The positions of these blocks are selectively variable, and a releasable latch arrangement connects the yarn guide to a splicing block during movement thereof in order to automatically vary the starting position of the next stitched row.

9 Claims, 9 Drawing Figures

KNITTING METHOD AND APPARATUS

The present invention relates to a method of knitting fully fashioned garment sections and/or garment sections of the Intarsia type, such as the front sections of sweaters, pullovers, vests, back sections, sleeves and similar garment section.

Knitting of garment sections requires the use of knitting machines that permit selection of the needles, depending on the form and/or pattern to be knitted, and requires the purchase of Jacquard machines or the like. From the state of the art, there are already known knitting machines capable of producing this type of article, such machines generally containing Jacquard mechanisms, needle-selecting mechanisms, etc., which have the disadvantage of being complex and expensive. In this regard, preparation times for a series of Jacquard patterns are long, and the storage of many patterns only for the fabrication of just one article size very quickly becomes extensive and costly.

It is also known that temporarily inoperative needles in a knitting machine constitute a major drawback. They can lead to rupture of the crocheting and subsequent problems.

It is an object of the present invention to fabricate a portion of an article, the article itself, or a pattern, on a simple, conventional knitting machine without needle selection, and thus without a Jacquard device, and of eliminating the drawbacks mentioned.

In accordance with one aspect of the present invention, knitting of a row of stitches is interrupted independently of the width of the working area of the active needles in order to change the number of stitch columns. The length of a row of stitches also is caused to vary by the displacement of at least one carrier splicing block with respect to another and the length of a row of stitches is limited by the position of two carrier splicing blocks relative to one another. In addition, a row of stitches is displaced with respect to the preceding row by displacing two carrier splicing blocks in one and the same direction by one and the same amount.

The process is performed by a device in which each guide bar has at least one rail for guiding the yarn guide and at least one rail for the guiding carrier splicing block. One of the guide bars has at least two worm screws for displacing the carrier splicing blocks, and each yarn guide has a locking means controlled by the drive piston of the yarn guide in a plane perpendicular to that in which the piston operates.

The above, and other objects, features and advantages of this invention will be apparent in the following detailed description thereof which is to be read in conjunction with the accompanying drawings, wherein.

Figure 1:
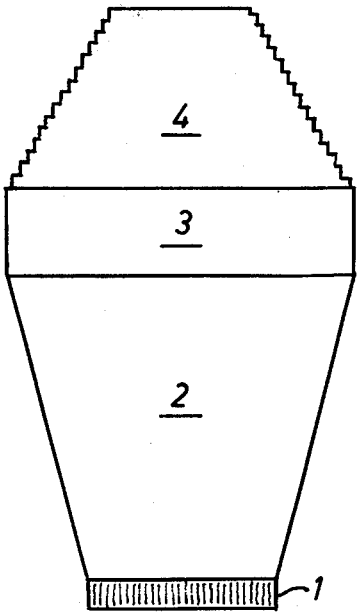
FIG. 1 is a plan view of a portion of an article knitted by the present invention.
Figure 2:
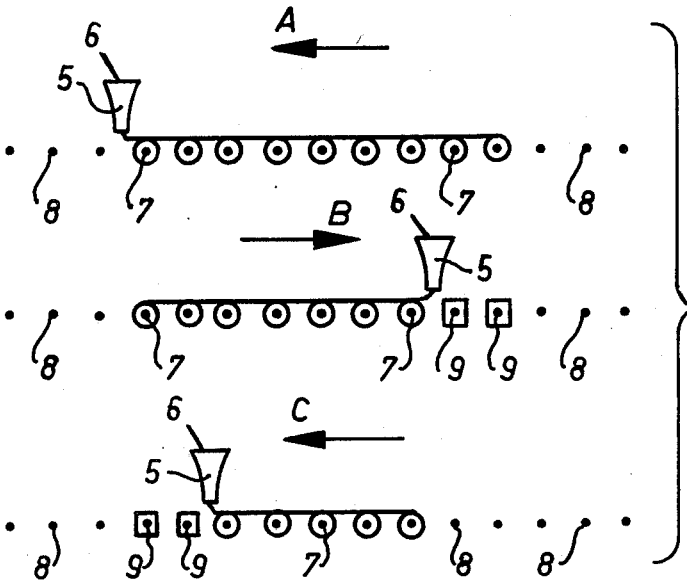
FIG. 2 is a schematic illustration of the operating cycles of the method of the present invention.

The knitted article shown in FIG. 1, which may for example be a portion of a garment, has ribbed or false ribbed material section 1, a widened portion 2, a straight portion 3, and a narrowed portion 4. The process by which part 4 of this article is knitted is illustrated in FIG. 2. As seen therein the yarn hook 5 has moved in the direction of the arrow A within the limits of the stroke set by the carrier splicing blocks described hereinafter. The yarn 6 engages the needles 7, which form a stitch, while the needles 8, which are also in operation, form no stitches since yarn hook 5 does not supply them with yarn. When the yarn hook 5 returns in the direction of the arrow B and the corresponding splicing block (not shown in this figure) at the right end of its path of travel has been displaced two needles to the left from the original right end of the path of hook 5, (this occurs during movement of yarn hook 5 to the right) then the hook furnishes yarn to all the needles 7 encountered on its path so that they can form a stitch, but does not supply yarn to needles 9. These needles are not on the path of the yarn hook so they cannot form a stitch and rather flatten the stitches formed at the time of the preceding knitted row. The needles 8 are always in operation but neither form or pass any stitches.

Movement of the yarn hook in the direction of arrow C, with similar movement of the splicing block at the left end of the yarn hook travel to the right for a distance of two needles, produces the same effects previously described.

The choice of the number of needles 9 by which the stitch is to be flattened is variable and may be programmed to the form of the article to be knitted.

Kntitting of part 3 is done normally without movement of the carrier splicing blocks, since it is of uniform width.

Knitting of part 2 is similar to the knitting of part 4, described above. To do that, it is only necessary to increase the stroke of the yarn hook in accordance with the article profile desired, by increasing the range of the yarn hooks 5, i.e. by lengthening the distance between the two carrier splicing blocks.

Figure 3:
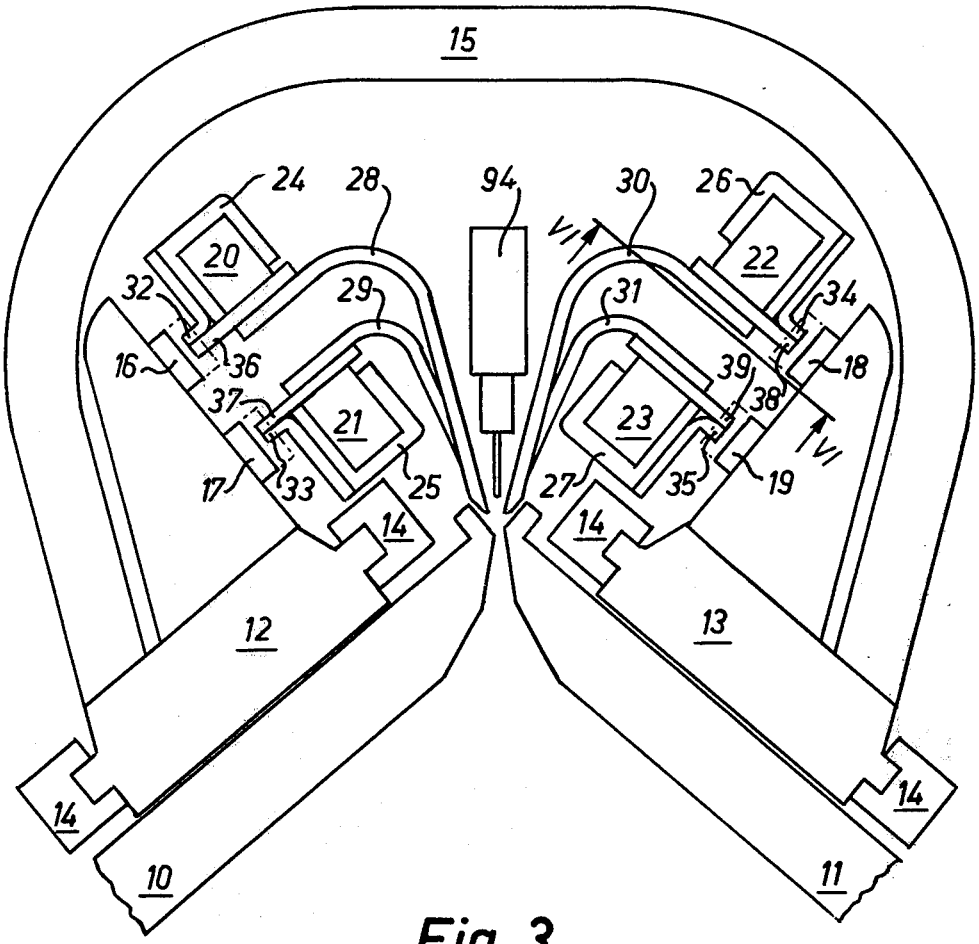
FIG. 3 is a schematic sectional view of a knitting machine constructed in accordance with the present invention.

FIG. 3 schematically illustrates the method of mounting the shaping device on a knitting machine, which includes needle beds 10, 11 (having grooves formed therein in which the needles slide and operate in the conventional manner), knitting carriages 12, 13 (with their sliding rails 14) and a stirrup 15 in a conventional manner. The machine includes pistons 16, 17 on carriage 12 and drive pistons 18, 19 on carriage 13 which are controlled by known means that need not be described or illustrated here.

The knitting machine includes guide bars 20, 21, 22 and 23 which are fastened to each end of the knitting machine in a known manner, not shown. A carrier splicing block 24, 25, 26, and 27, and yarn guides 28, 29, 30, and 31 are also provided which are adapted to be moved along each guide bar. Each carrier splicing block has a cam 32, 33, 34, 35, (to permit release of an associated piston 16, 17, 18, 19) and a yarn guide which has tenons or projections 36, 37, 38, 39, positioned to be engaged by the yarn guides associated pistons 16, 17, 18, 19, to thereby move the yarn guide along within the limits defined by the carrier splicing blocks on the same guide bar on which the yarn guide moves. In this connection there are usually two splicing blocks on each guide bar in spaced relation to each other limiting the movement of the yarn guide therebetween.

Figure 4:
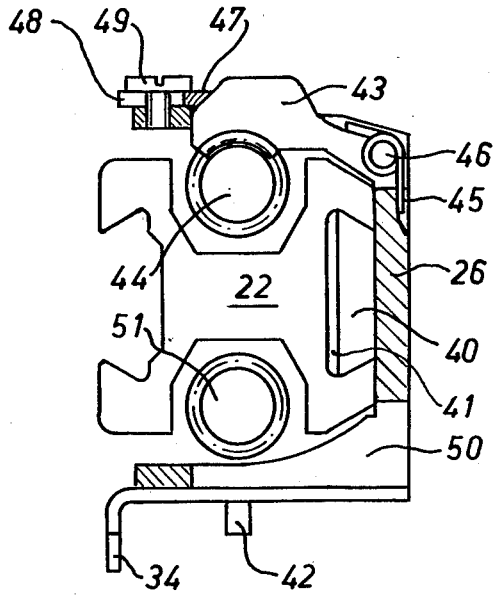
FIG. 4 is an enlarged view of a portion of the machine shown in FIG. 3.

A carrier splicing block 26 is shown in detail in FIG. 4 and comprises a lardon or strip 40 that is an integral part of the carrier splicing block slidably received in a groove 41 of guide bar 22. Cam 34 is an integral part of the carrier splicing block and has a tenon or projection 42 which, in certain positions of the yarn guide, is hooked onto by the guide to form an operative connection. The hooking on and locking of the yarn guide on the carrier splicing block will be described further below in connection with FIGS. 6 and 7 of the drawing.

Each carrier splicing block also has a jar 43 which meshes with a worm screw 44 that is mounted in the knitting machine and extends parallel to the guide bar 22. The worm screw is adapted to be driven by motors (not shown). A torsion spring 45 mounted on the pivot axis 46 of jaw 43 provides play free engagement of the jaw with worm screw 44.

A small plate 47, having a groove 48 formed therein is held on the carrier splicing block by a screw 49. This plate forces the jaw 43 to remain engaged with the worm screw. However, by loosening screw 49, one can displace plate 47 to permit rotation of jaw 43 about its axis. The carrier splicing block can thus be positioned or shifted manually and quickly along the guide bar.

An opening 50 is provided in the carrier splicing block for installing another jaw 43 (not shown) therein identical to the one just described to threadably engage the carrier splicing block with a second rotatable worm screw 51. This type of construction (i.e. the dual worm screws) permits displacing two carrier splicing blocks moving along the same guide bar 22 in either the same or opposite directions by different or identical amounts of displacement simply by coordinating or combining the directions of rotation of the two worm screws 44 and 51. In this regard, it is noted that all the worm screws are preferably independently controlled by known means, not shown, such as synchronized motors, for example. Such motors, following the contour of the section or pattern are also controlled by known program means which are not shown in the drawings, but whose operation and structure would be apparent by those skilled in the art.

Figure 5:
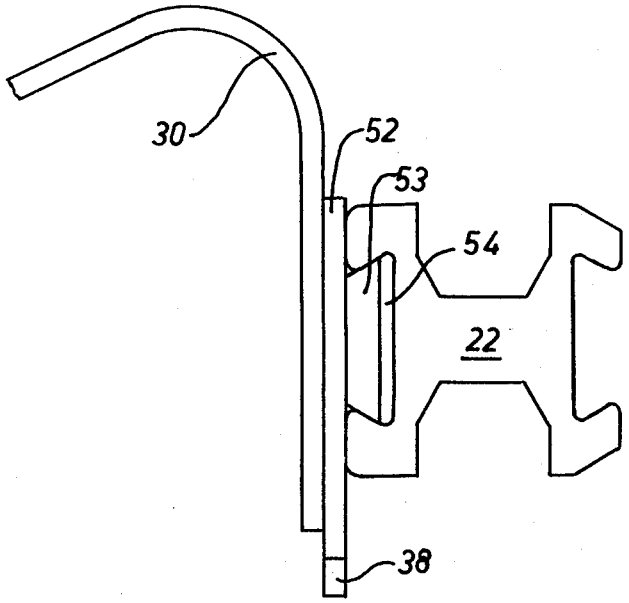
FIG. 5 is an enlarged view of another portion of the machine shown in FIG. 3.

The yarn guide 30, partially shown in FIG. 5, is rigidly combined with a plate 52 containing the drive tenons or projections 38. A lardon 53, slidably received in the groove 54 of guide bar 22, is also solidly combined with plate 52. Of course it is to be understood that the other guide bars of the machine (namely bars 20, 21, and 23 shown schematically in FIG. 3) are similar to and equipped in the same way as the yarn guide 30 shown in FIGS. 4 and 5.

The hooking on and locking device of the carrier splicing blocks will now be described in detail in conjunction with FIGS. 6 and 7. As seen therein, the piston 18 (of conventional construction) is adapted to move in the direction of the arrow D. In doing so the operative end of the piston shown in the drawing engages the tenon 38 at the right in FIG. 6 and drives plate 52, carrying yarn guide 30, to the right until the end of the piston engages the ramp surface 55 of cam 34, on splicing block 26, so that it is retracted and no longer in contact with tenon 38. Thus movement of the yarn guide is stopped.

Figure 6:
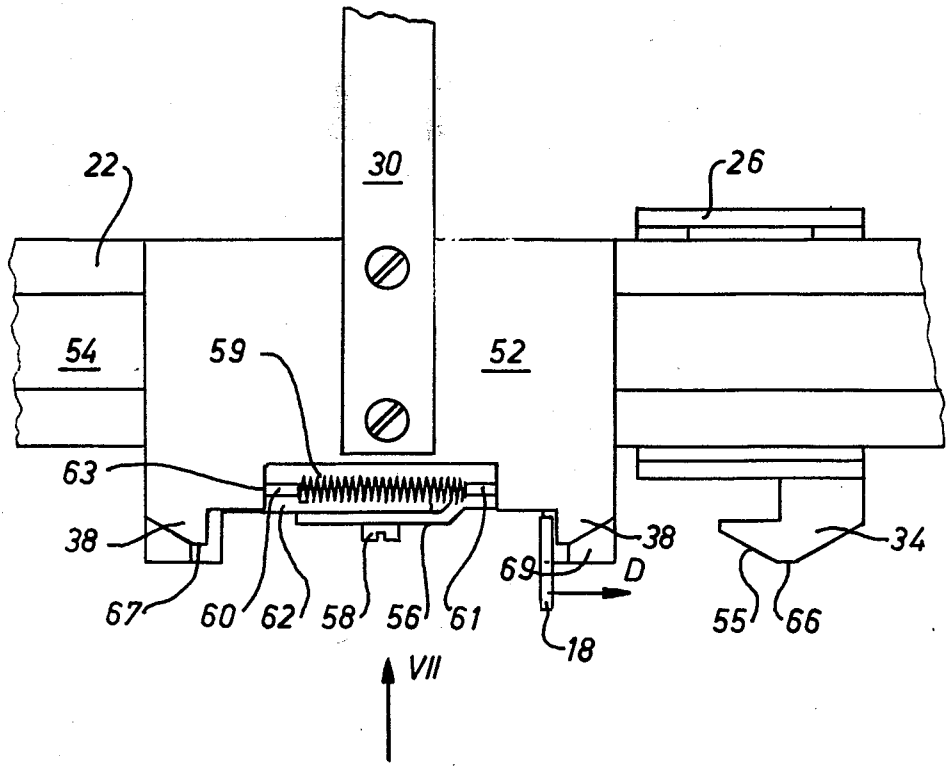
FIG. 6 is an enlarged sectional view taken along line VI—VI of FIG. 3.
Figure 7:
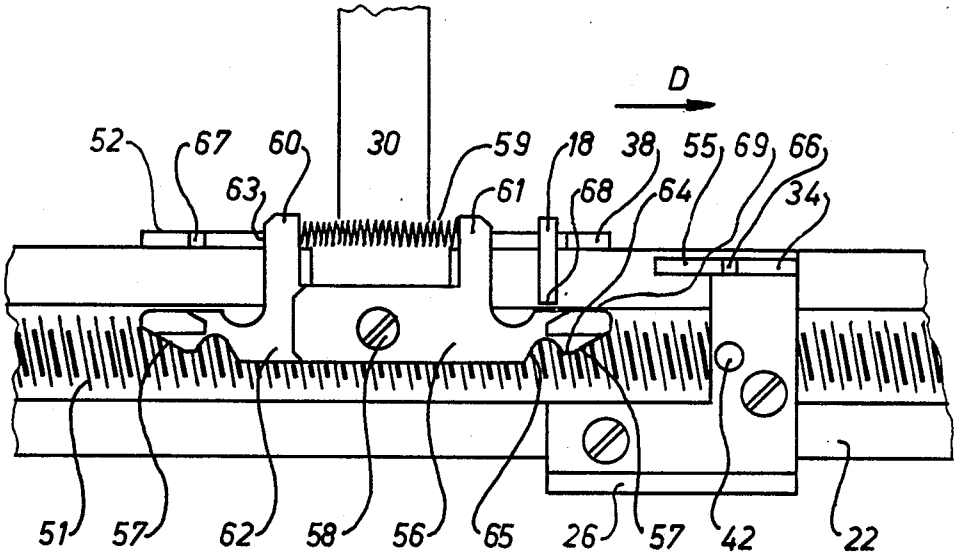
FIG. 7 is an enlarged view of a portion of FIG. 6, taken in the direction of the arrow VII section.

FIG. 7 is a view of the device of FIG. 6 in the direction of the arrow VII. As seen there, it should be noted that the yarn guide plate 52 has a locking lever 56, mounted thereon in any convenient manner. This lever includes a cam or ramp surface 57 which is located to come into contact with tenon 42 on splicing block 26. With piston 18 still in contact with tenon 38 and driving plate 52 to move in the direction of the arrow D, when tenon 42, which is fixed to the carrier splicing block 26, engages locking lever 56, the locking lever pivots about its pivotal mounting axis 58 against the bias of a compression spring 59 positioned between the branches 60 and 61 of locking lever 56 and its associated oppositely directed lock lever 62. Branch 60 of locking lever 62 (which is also pivotally mounted on axis 58) abuts against the bearing surface 63 of plate 52 (see FIG. 6) and thus cannot pivot counterclockwise under the influence of spring 59. As piston 18 continues to move in the direction of arrow D tenon 42 passes behind the peak 64 of ramp 57 and enters gap or recess 65 of locking lever 56. At that same instant, piston 18 arrives at the peak 66 of cam 34 (which extends above or beyond the peak 67 of tenon 38) so that the drive applied to the yarn hook by piston 18 is stopped and the yarn guide is locked in this position on the splicer block. Moreover the side or surface 68 of piston 18 (see FIG. 7) passes along the side edge 69 of locking lever 56 and prevents the rebound of this lever on tenon 42 and thus prevents inadvertent disengagement thereof. Through this locking system, the position of the yarn guide 30 with respect to carrier splicing block 26 is always constant and certain. The same system of hooking the yarn guide to the carrier splicing block is provided for displacement of the yarn guide in the reverse direction towards the other splicing block (not shown in guide rod 22) by means of the locking lever 62. The tenon 42 and the spring 59 guarantee a positive hook on to permit the movement of a carrier splicing block and the yarn guide, which is hooked on thereto by means of the worm screw. The yarn guide moves together with the splicing block 26 (FIG. 7) since it is pulled or pushed by means of the tenon 42 in the recess 65. The spring 59 is strong enough to permit this coupling of the said elements. When the yarn guide is moved in the direction opposite to the arrow D (FIG. 6) the piston 18 moves tenon 38 to the left in said FIG. 6. Since the splicing block 26 is retained by the worm screw 51 the tenon 42 will lift the locking lever 56 against the action of the spring 56.

As a general rule for a linear knitting machine, the carrier splicing blocks are displaced at the time of a reversal in direction of the knitting carriage. With the present invention, because of the combination of two or more guide bars, several selvages can be made on the same article, to knit a V neck line on the front panel of a sweater, for example. By combining several pairs of carrier splicing blocks on one and the same guide bar, it is possible to knit several articles of the same shape at the same time.

Figure 9:
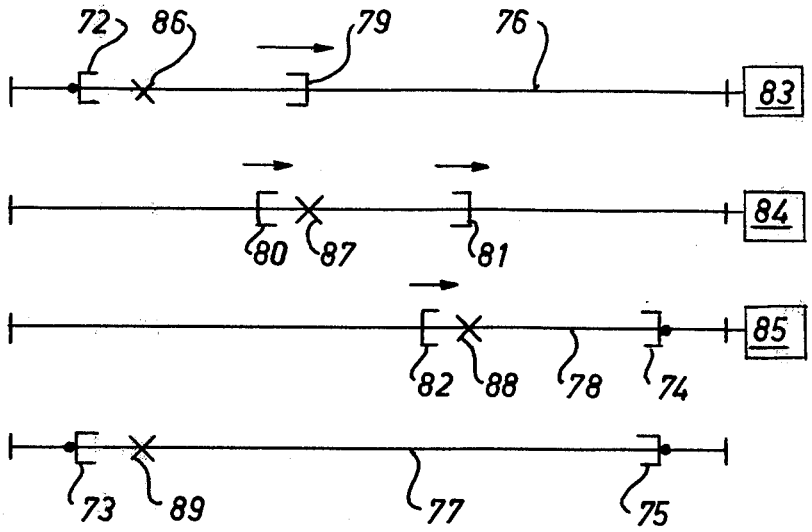
FIG. 9 is a schematic drawing showing an example of an arrangement of the carrier splicing blocks for producing the article of FIG. 8.
Figure 8:
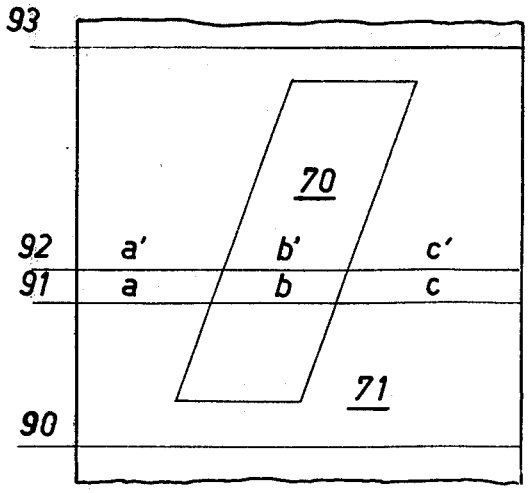
FIG. 8 shows an article of the Intarsia type.

The Intarsia type knit of FIG. 8 includes a design 70 and a background color 71. This sample can be obtained, for example, by an arrangement of the splicing blocks like that shown schematically in FIG. 9.

Carrier splicing blocks 72, 73 and 74, 75 are stationary and are rigidly coupled to guide bars 76, 77 and 78, respectively. They do not mesh with a worm screw and are manually set at the time the machine is started.

Carrier splicing blocks 79, 80, 81 and 82 on the other hand are of the type described in connection with FIG.

4, and are rigidly coupled with a worm screw, not shown in this drawing. These blocks move in accordance with a program corresponding to the design 70 by the synchronized motors 83, 84, 85. Yarn guides 86, 87, 88, 89 are represented by a cross and can be moved by the carriage within limits defined by the carrier splicing blocks.

The row of knitting 90 is made by moving the yarn guide 89 between the carrier splicing blocks 73 and 75 as many times as is necessary.

The row 91 is knitted by three yarn guides, yarn guide 86, which moves from fixed splicing block 72 to the movable carrier splicing block 79; yarn guide 87 which moves between the carrier splicing blocks 80, 81; and yarn guide 88 which moves from movable carrier splicing block 82 to the fixed carrier splicing block 74.

Before the next row 92 is knitted, motor 83 is started to displace the carrier splicing block 79 in the direction of the arrow to widen the row of stitches a which will become a'. Simultaneously, motor 84 will move carrier splicing blocks 80 and 81 also to the right by the same amount, which has the effect of displacing to the right the next portion of the row of stitches b', which remains the same length as the portion b. Motor 85 will also be started to move the carrier splicing block 82 so that the portion c of the next row of stitches be reduced to c' and so on.

The row of stitches 93 is knitted in the same way as row 90. The guide bar 77 is of the conventional type used in knitting machines.

Such a method can be used to advantage in combination with a stitch pressing device 94, shown in FIG. 3.

The knitting machine operator thus has a simple device for use on a simple knitting machine that will allow him to combine the advantages of a shaped section and a knit of the Intarsia type.

Evidently, this invention is not limited to sections of clothing but can be applied to any knitted article without going beyond its scope.

Although an illustrative embodiment of the present invention has been described herein, it is to be understood that the invention is not limited to that precise embodiment and that various changes and modifications may be effected therein without departing from the scope or spirit of this invention.

What is claimed is:

1. The method of knitting sections of predetermined contour and/or of a design of the Intarsia type of predetermined shape comprising the steps of moving a yarn guide member along a bank of needles in a knitting machine between a pair of carrier splicing blocks movably mounted in the machine for independent variable relative movement; selectively and independently varying the relative position and spacing of said splicing blocks in said machine, and releasably connecting said yarn guide to one of said splicing blocks during movement thereof to vary the starting position of the next knitted row.

2. The method as defined in claim 1 including the step of varying the lengths of the rows of stitches being knitted by selectively varying the spacing between said carrier splicing blocks.

3. The method as defined in claim 1 including the step of displacing one row of stitches with respect to another row of stitches by moving said carrier splicing blocks in the same direction in the knitting machine and by the same amount.

4. The method as defined in claim 1 including the step of moving a first yarn guide between a fixed carrier splicing block and one of said movable carrier splicing blocks; moving a second yarn guide between said movable carrier splicing blocks, moving a third yarn guide between the other of said movable carrier splicing blocks and another fixed carrier splicing block; and performing said step of varying the position of the movably mounted splicing blocks between knitting of at least a predetermined number of rows of stitches.

5. An apparatus for use in knitting sections of predetermined contour and/or of a design of the Intarsia type of predetermined shape in a knitting machine having a bank of needles; said apparatus comprising a yarn guide, means for moving said yarn guide transversely of the bank of needles; a pair of carrier splicing blocks; means for movably mounting said carrier splicing blocks in said machine on opposite sides of the path of travel of the yarn guide for independent variable relative movement; means for independently adjusting the relative positions and spacing of said carrier splicing blocks to each other and to the needles; and means for releasably connecting said yarn guide to one of said splicing blocks during movement thereof to vary the starting position of the next knitted row.

6. The apparatus as defined in claim 5 including means for varying the positions of said carrier splicing blocks.

7. The apparatus as defined in claim 6 wherein said splicing block moving means includes a threaded rod threadably engaged with said blocks and extending parallel to the path of travel of the yarn guide; and means for rotating said rod.

8. The apparatus as defined in claim 7 wherein said releasably connecting means comprises a lock pin on said block and means on the yarn guide for releasably engaging the pin.

9. The apparatus as defined in claim 8 wherein the knitting machine includes means for moving said yarn guide between said splicing blocks includes means for disengaging the yarn block moving means from the yarn block at the same time said pin is engaged by said latching means.

* * * * *